US010307807B2

(12) United States Patent
Yamamoto

(10) Patent No.: US 10,307,807 B2
(45) Date of Patent: Jun. 4, 2019

(54) EXTRUSION PRESS

(71) Applicant: Ube Machinery Corporation, Ltd., Ube-shi (JP)

(72) Inventor: Takeharu Yamamoto, Ube (JP)

(73) Assignee: Ube Machinery Corporation, Ltd. (JP)

( * ) Notice: Subject to any disclaimer, the term of this patent is extended or adjusted under 35 U.S.C. 154(b) by 98 days.

(21) Appl. No.: 15/509,545

(22) PCT Filed: Jul. 1, 2015

(86) PCT No.: PCT/JP2015/069000
§ 371 (c)(1),
(2) Date: Mar. 8, 2017

(87) PCT Pub. No.: WO2016/056276
PCT Pub. Date: Apr. 14, 2016

(65) Prior Publication Data

US 2017/0297068 A1 Oct. 19, 2017

(30) Foreign Application Priority Data

Oct. 6, 2014 (JP) ..... 2014-205330

(51) Int. Cl.
*B21C 23/21* (2006.01)

(52) U.S. Cl.
CPC ..... *B21C 23/21* (2013.01); *B21C 23/211* (2013.01)

(58) Field of Classification Search
CPC ..... B21C 23/21; B21C 23/211; B21C 23/212; B30B 11/22; B30B 11/221; B29C 47/0801
See application file for complete search history.

(56) References Cited

U.S. PATENT DOCUMENTS

2012/0244239 A1* 9/2012 Yamamoto ..... B21C 23/211 425/258

FOREIGN PATENT DOCUMENTS

| | | | |
|---|---|---|---|
| CN | 102652040 | A | 8/2012 |
| CN | 202671090 | | 1/2013 |
| JP | 3074669 | B2 | 8/2000 |
| JP | 2002-154789 | A | 5/2002 |
| WO | 2011/074106 | A1 | 6/2011 |

* cited by examiner

*Primary Examiner* — Pradeep C Battula
(74) *Attorney, Agent, or Firm* — DLA Piper LLP (US)

(57) ABSTRACT

An electric powered extrusion press pushes an extrusion stem by extrusion force generated by an electric powered drive device so that pressure is applied to a billet and a predetermined product is extruded through a die, wherein the electric powered drive device is provided with one or more freely rotatable wire drums, an electric powered extrusion-use main motor makes the wire drums rotate wind up wires and thereby give a thrust to movable pulleys in the extrusion direction so that a crosshead and extrusion stem are driven to advance through an extrusion movement part.

6 Claims, 9 Drawing Sheets

A-A

EXTRUSION PRESS

TECHNICAL FIELD

The present invention relates to an extrusion press, more particularly relates to an extrusion press device extruding aluminum or aluminum alloy or other metal material through a die, especially an electric powered extrusion press using electric power to drive the extrusion operation.

BACKGROUND ART

An extrusion press is used for extruding aluminum frame parts or other metal products. In past extrusion presses, the starting material, that is, the billet, was loaded into a fixed container. This was then pushed by an extrusion stem driven by a ram cylinder (hydraulic cylinder). The billet was made to pass through a die positioned to the outlet of the container to thereby be extruded to a predetermined cross-sectional shape. Specifically, the billet loaded in such a molding machine is supplied by a billet loader. The billet loader grips a billet sent from a billet carrier arranged at the side of the molding machine and conveys it to the billet loading opening of the container. It loads the transferred billet into the container pushed by the extrusion stem in the state with the billet and loading opening centered. After that, the billet is extruded under pressure whereby it is formed into the shape of the final product.

Among the products extruded by an extrusion press, there are aluminum frame members and other long products. In the case of long products, the extrusion stem pushes the billet for a long period of time. For this reason, a hydraulic cylinder able to operate with a long stroke at a high pressure has been used for the ram cylinder for pushing the extrusion stem. However, such a conventional extrusion press device has been driven by hydraulic pressure, so there were challenges such as protection of the environment (against noise, oil leakage, etc.), reducing energy consumption (lowering running costs), etc. To meet these challenges, realization of a press using the electric powered drive system employed in plastic injection molding machines or die cast machines for die casting aluminum alloys has been demanded. In the case of an electric powered drive system, in general, it is necessary to convert the rotary motion of a first stage drive device comprised of an electric motor to linear motion or back and forth linear motion.

In conventional hydraulic cylinder devices, the larger output capacity sought from an extrusion press, for example, 9800 kN (that is, 1000 tf) or more, can be continuously output. However, no mechanism has yet been realized for converting rotary motion to linear motion taking the place of conventional hydraulic cylinder devices. Therefore, electric powered drive systems have not been applied to extrusion presses.

A conventional extrusion press is a machine using a motor and pump to drive a plurality of hydraulic devices to produce an extruded product. During the extrusion process of course and also processes other than the extrusion process, for example, even in the discard cutoff step, billet loading step, etc. as well, the same pump and motor are used as sources of drive power. Here, the extrusion-use pump and motor utilizing hydraulic devices and an auxiliary pump and motor have to be kept constantly operating in an idling mode even when not directly required for operation of the extrusion press device. Power loss therefore occurs.

Further, when a machine user uses a machine for a long time, maintenance and inspection are required for continued operation. Comparing when the drive source is a hydraulic source and when it is only an electric motor, it is believed that the time required for maintenance would be overwhelmingly longer in the case of a hydraulic source. The reason is that when using hydraulic equipment for many years, the hydraulic fluid degrades, the valves become worn, fluid leaks from the pipe joints, and other trouble occurs at the pumps, valves, manifolds, piping, and numerous other parts. Much time is required for identifying the causes of the trouble and taking measures against them. In this way, there were the following defects in conventional hydraulic drive type extrusion presses:

(1) Since hydraulic fluid was used as the medium for the drive force, realization of the speed and precision of position crucial to mechanical operation was difficult.

(2) The energy loss was relatively great and cooling water was required for preventing a rise in fluid temperature, so the running costs swelled.

(3) A hydraulic circuit has many high pressure components and generates high noise at the time of operation.

(4) Since a large amount of hydraulic fluid is used, leakage of the hydraulic fluid causes problems in maintenance, the environment, and costs while disposal of the hydraulic fluid causes problems in the environment and costs.

To deal with these problems, PLT 1 proposes a completely electric powered type extrusion press. In this prior art, the extrusion drive device is provided with four electric powered extrusion-use main motors for driving a single extrusion stem. Four wire drums are driven to rotate by the respective electric powered extrusion-use main motors so as to make the crosshead to which the extrusion stem is fastened move back and forth. Each wire drum has first ends of 10 single strand wires fastened to it. The other ends are fastened to a crosshead fastening member. Each wire is strung straight without anything interposed between the wire drum and the crosshead connecting member. The four wire drums are made to simultaneously rotate to wind up the wires in a simple manner and make the crosshead move back and forth. In this prior art, rotary motion is converted to linear motion by the plurality of wires being wound up on the wire drums, but the wires are just linearly connected, so the output is insufficient. For this reason, four electric powered extrusion-use main motors had to be used. Further, 10 wires had to be attached between each wire drum and crosshead connecting member by a uniform tension (unless uniform tension, the load will be applied to a specific wire and cause breakage or other issues). Installation and adjustment were extremely troublesome.

CITATION LIST

Patent Literature

PLT 1: WO2011/074106A

SUMMARY OF INVENTION

Technical Problem

As explained above, in a conventional extrusion press, there were the problems of poor precision and energy efficiency, a detrimental effect on the environment, troublesome adjustment, and other problems, so improvement of an electric powered extrusion press for solving these problems has been sought. The present invention was made in consideration of the above-mentioned situation and has as its object to provide an electric powered extrusion press which is excellent in precision, is improved in energy efficiency, has no detrimental effect on the environment, is improved in maintenance ability and operating ability, and reduces noise.

The present invention has as its object the provision of a compact extrusion press powered electrically.

Solution to Problem

An electric powered extrusion press pushing an extrusion stem by extrusion force generated by an electric powered drive device so that pressure is applied to a billet and a predetermined product is extruded through a die, wherein the electric powered drive device is provided with one or more freely rotatable wire drums, an electric powered extrusion-use main motor makes the wire drums rotate to wind up wires and thereby give thrust to movable pulleys in the extrusion direction so that a crosshead and extrusion stem are driven to advance through an extrusion movement part provided with the movable pulleys, is provided.

Preferably, a wire is wound around each wire drum from the two ends. The two ends of the wire are fastened by connection to the wire drum through fixed pulleys and movable pulleys.

Alternatively, a wire is wound around each drum from one end part. One end part of the wire is fastened to the wire drum, while the other end part is fastened to a fastening location.

Preferably, one or more electric powered drive devices are arranged in the extrusion direction in series and are connected through the components for transmitting the extrusion force and components for receiving the reaction force of the extrusion force to enable all sorts of capabilities of extrusion force to be handled.

The combined pulleys are given the function of a speed reducer.

A wire slack preventing device is attached.

A tail end electric powered drive device is provided with a high speed movement mechanism enabling the crosshead to advance and retract at a high speed.

Among the components of the electric powered drive devices, the components for transmitting the extrusion force and the components for receiving the reaction force of the extrusion force comprise stronger parts endurable against the loads acting on the electric powered drive devices, the further away from the main crosshead of the extrusion press.

Advantageous Effect of Invention

The present invention does not use any hydraulic devices for its main parts but uses an electrically powered drive system, so the maintenance ability can be improved, energy can be saved, and the operating efficiency and performance of the machine become excellent. Further, the source of noise changes from the main pumps to the main motors, so the noise can be reduced. Therefore, the work environment is improved, the machine becomes good in operability, and a greater improvement to the productivity of the extruded product is realized.

Further, since the load transfer medium is a single through wire, even if connected to a plurality of pulleys, it passes over the pulleys by the same tension so is automatically adjusted in tension. There is no need for the troublesome adjustment of tension like in the prior art. On top of this, since a plurality of pulleys are connected in parallel, the assembly acts as a speed reducer, it becomes possible to lower the speed reduction ratio of the speed reducer used from the main motor to the wire drum to boost the power, and the electric powered drive device as a whole can be configured from more compact drive parts.

Furthermore, by arranging a plurality of electric powered drive devices in the extrusion direction in series and connecting the movement parts of the crosshead (later explained extrusion movement parts 15) in series, even if a larger extrusion ability is required, this can be realized without the need to make the individual drive parts larger.

DESCRIPTION OF EMBODIMENTS

Below, an extrusion press of embodiments of the present invention will be explained in detail based on the drawings.

First Embodiment

Figure 1:
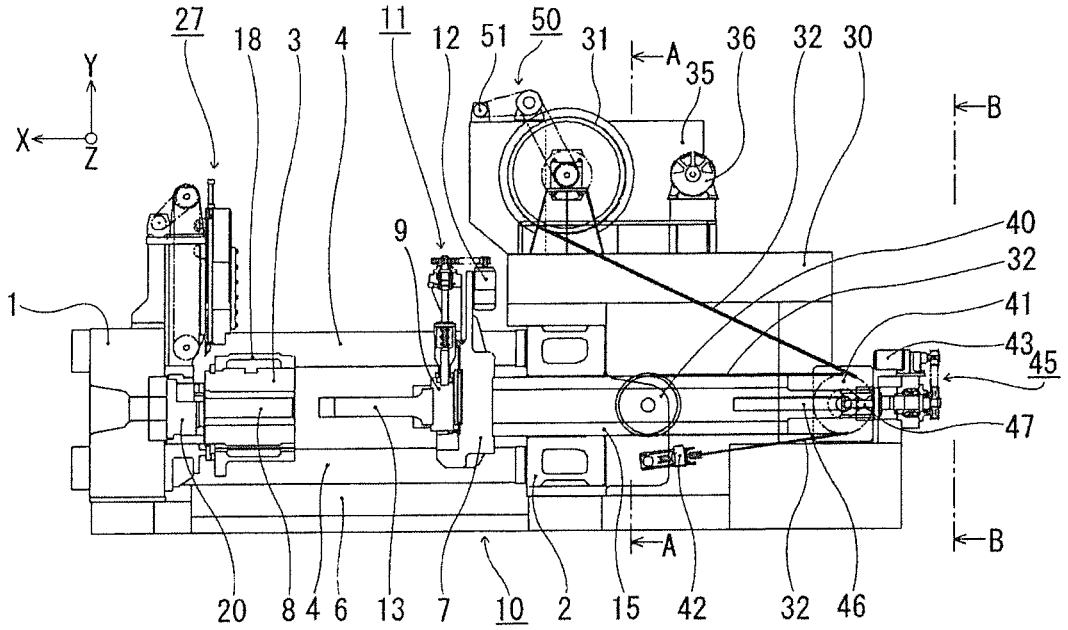
FIG. 1 is a schematic side view showing an extrusion press of a first embodiment of the present invention.
Figure 2:
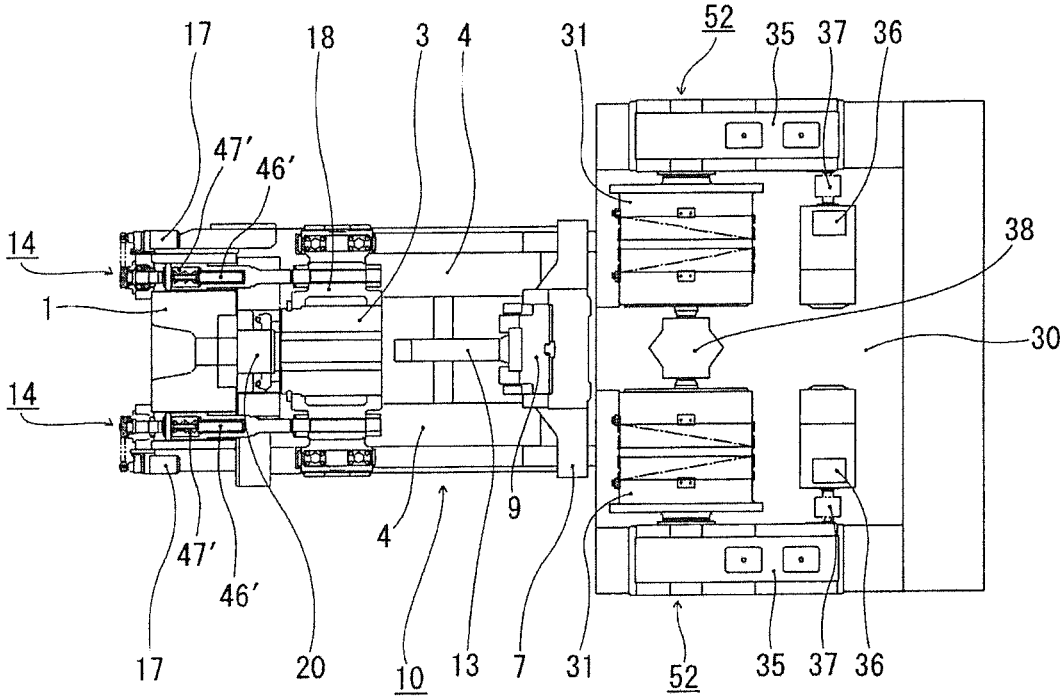
FIG. 2 is a plan view of FIG. 1 seen from above.
Figure 3:
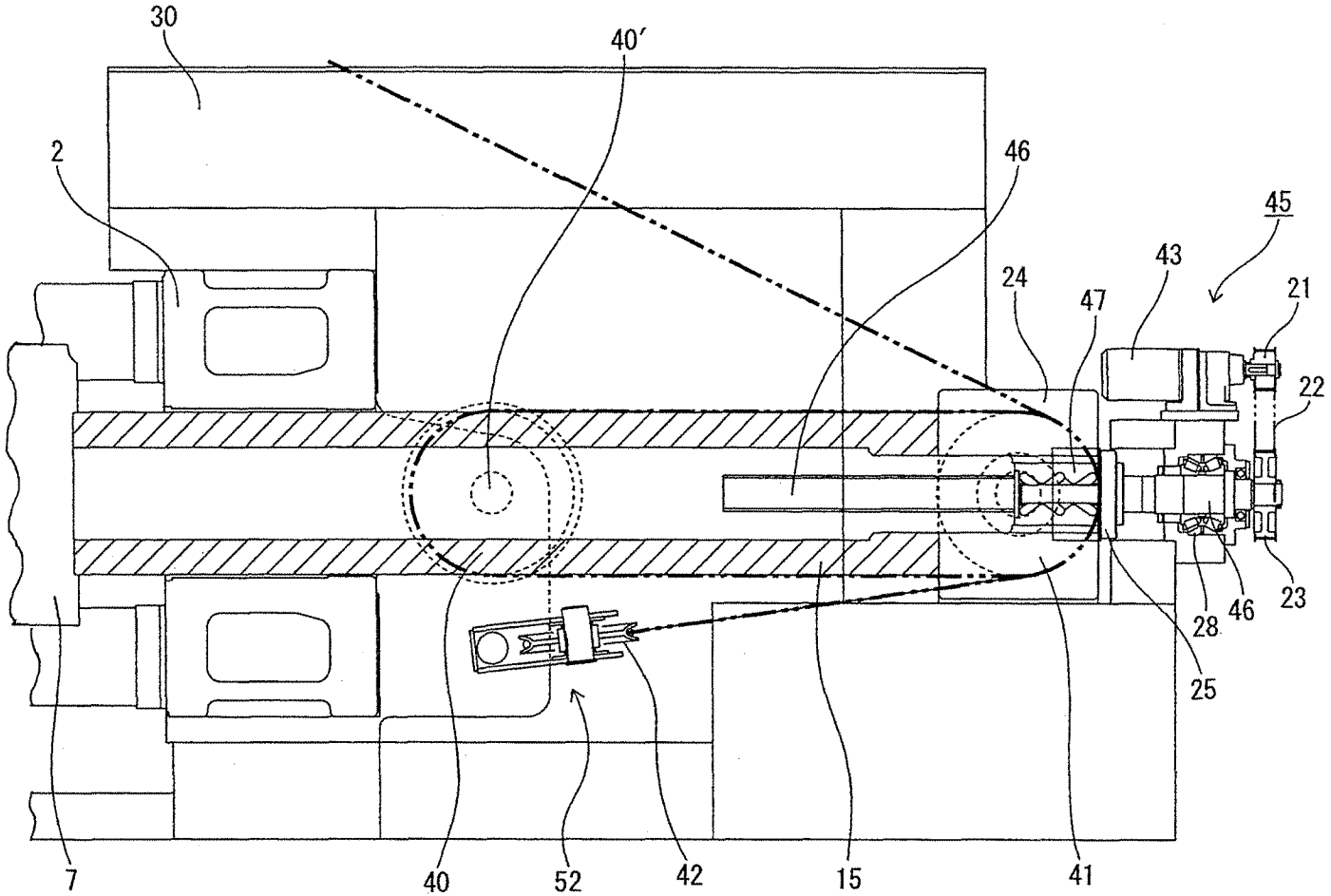
FIG. 3 is a partial enlarged view of FIG. 1.
Figure 4:
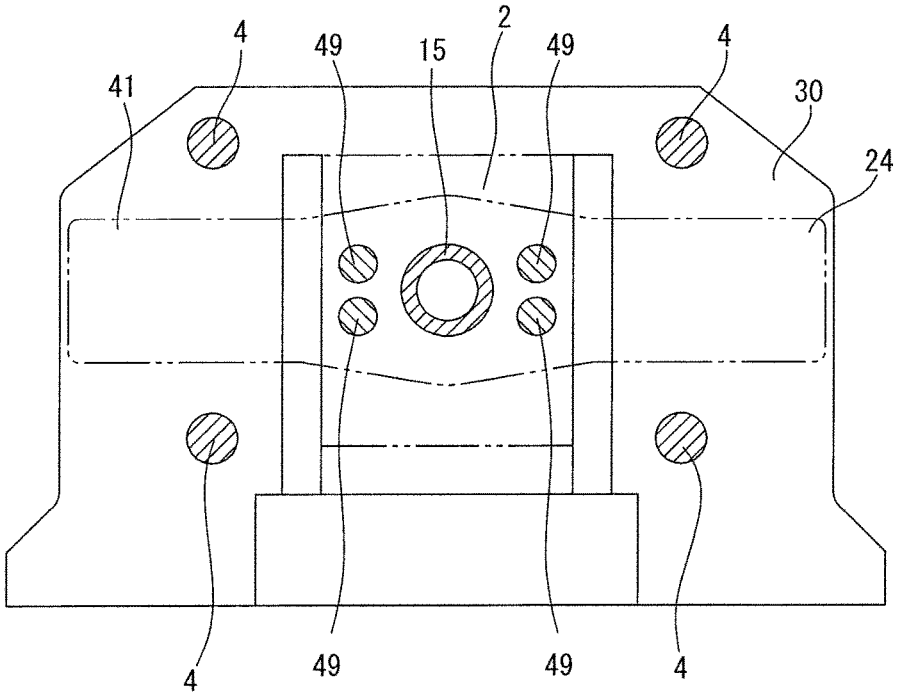
FIG. 4 is a cross-sectional view seen from A-A of FIG. 1.
Figure 5:
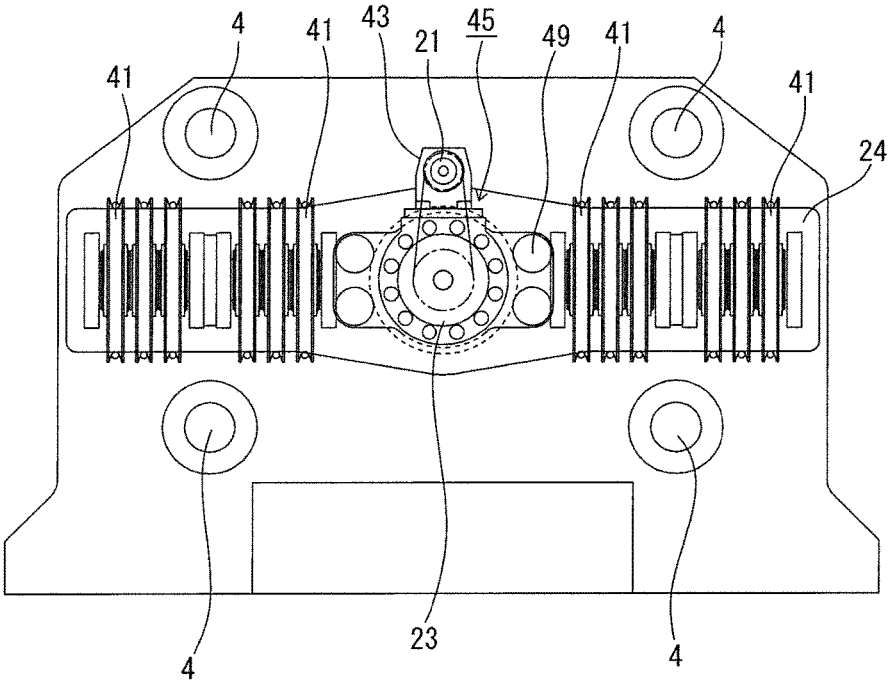
FIG. 5 is a side view seen from B-B of FIG. 1 and a rear view seen from the rear.

FIGS. 1 to 8 schematically show a first embodiment of an extrusion press according to the present invention (stem slide type extrusion press). FIG. 1 is a side view showing the schematic configuration of the extrusion press of the first embodiment. FIG. 2 is a plan view of the device of FIG. 1 seen from above. FIG. 3 is a partial enlarged view of FIG. 1. FIG. 4 is a cross-sectional view seen from A-A of FIG. 1. FIG. 5 is a side view seen from B-B of FIG. 1. FIG. 6 is a rear view seen from the rear. The extrusion press of the present invention is provided with an electric powered extrusion drive device converting rotary motion to linear motion. The extrusion press of the present invention pushes an extrusion stem by the extrusion force from the electric powered extrusion drive device. In general, it pushes an approximately 400 to 500° C. billet and extrudes it through a die to a product of a predetermined shape.

First, referring to FIGS. 1 and 2, an extrusion press 10 of the present embodiment is provided with an end platen 1 positioned at a front end part and a fixed platen 2 positioned near a center of the extrusion press. The billet 8 is extruded through a die 20 built into the end platen 1 to be formed into a predetermined shape. Here, the end platen 1 side is designated as the "front" and the fixed platen 2 side is designated as the "rear". In the present embodiment, the end platen 1 and the fixed platen 2, as shown in FIGS. 1 and 4, are connected by the four tie rods 4 arranged at the four corners. Between the end platen 1 and the fixed platen 2 and near the end platen 1, a container holder 18 is arranged. The container holder 18 supports a container 3 into which a billet 8 is loaded. At the fixed platen 2 side, a crosshead 7 is slidably supported by the four tie rods 4. The four tie rods 4 pass through the crosshead 7 at the four corners. The die 20 is arranged between the end platen 1 and container 3. At the end platen 1, a container operating device 14 is provided. The container 3 is driven by a container operating device 14 provided with a container operating motor 17 through a ball screw 46' and ball screw nut 47' to move in the front and rear directions.

Figure 8:
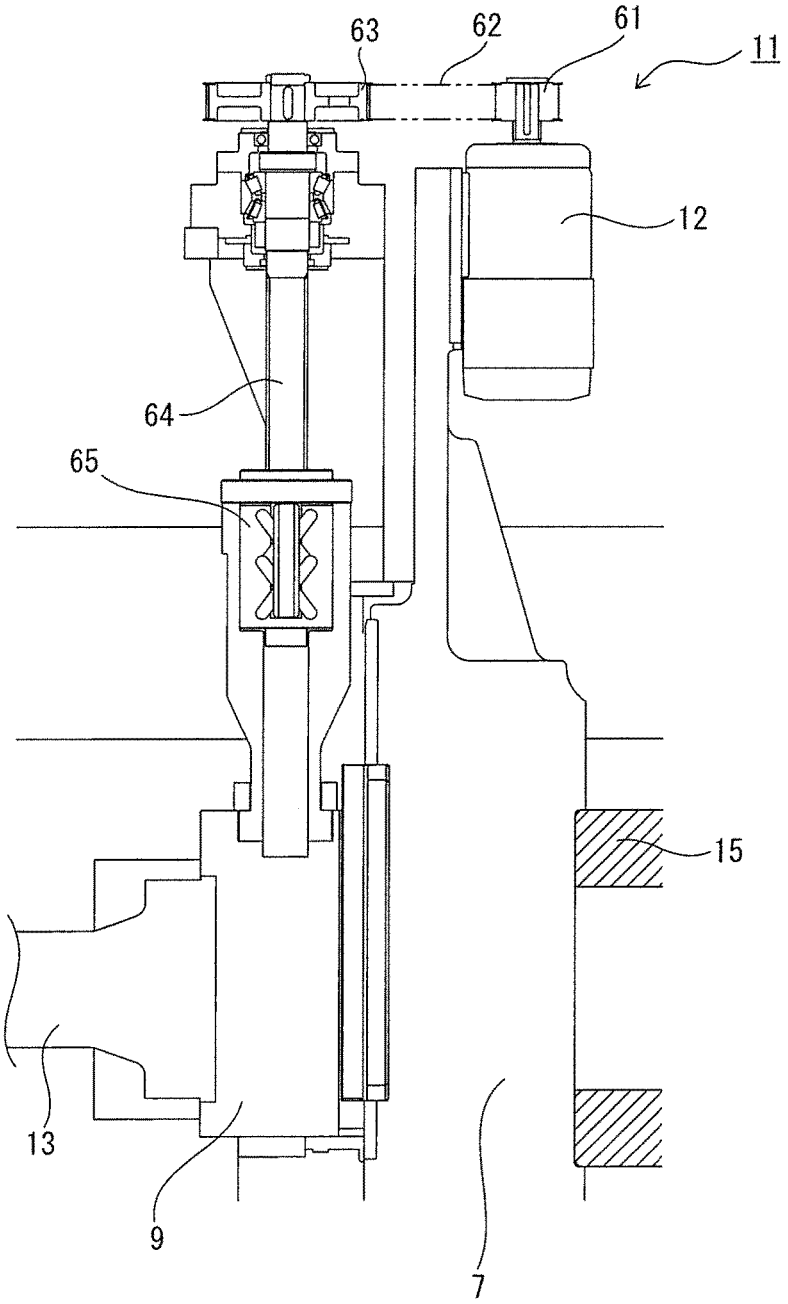
FIG. 8 is a partial enlarged view of a stem slide mechanism of FIG. 1.

At the center of the container side of the crosshead 7, an extrusion stem 13 is attached. The extrusion press 10 of the present embodiment uses a stem slide system. The "stem slide system" is a system enabling the extrusion stem 13 to move up and down by the stem slider 11 so as to enable loading of the billet by the billet loader. FIG. 8 is a detailed enlarged view of a stem slide type mechanism. A stem slide motor 12 is installed at the crosshead 7 and turns a ball screw 64 through a wheel 61, timing belt 62, and wheel 63. A ball screw nut 65 is fastened to a stem slide 9 supporting the extrusion stem 13. By rotation of the ball screw 64, the extrusion stem 13 can move up and down through the ball screw nut 65. In the present embodiment, the extrusion stem 13 is driven by the stem slide motor 12, but the stem slide motor 12 is preferably a variable speed inverter motor or AC servo motor.

As shown in FIGS. 1 and 3, at the fixed platen side of the crosshead 7, a hollow cylindrical (may also be polygonal shape or solid shape or other shape) extrusion movement part 15 is connected. The extrusion movement part 15 passes through a center hole of the fixed platen 2 and is supported by the fixed platen 2 to be able to slide. At the end part of the extrusion movement part 15 in the opposite direction to the fixed platen 2, as shown in FIGS. 1 and 3, a movable pulley 41 is attached. The extrusion movement part 15 is fastened at the left side end part of FIG. 3 to the crosshead 7 and is fastened at the right side end part to a span 24. At the span 24, a shaft of the movable pulley 41 is attached through a bearing. Movement of the extrusion movement part 15 and the span 24 in the extrusion direction is guided by the center hole of the fixed platen 2 and the four support columns 49 shown in FIG. 4.

Figure 6A:
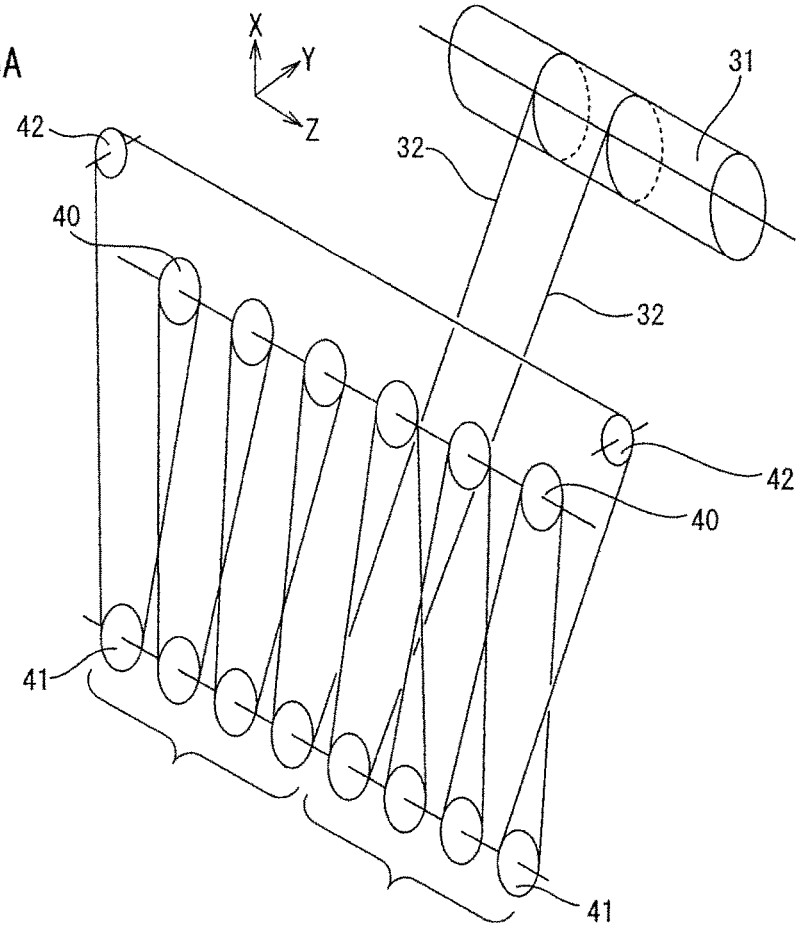
FIG. 6A is a schematic view of the wire layout in the case of fastening the two ends of the wire to a wire drum.
Figure 6B:
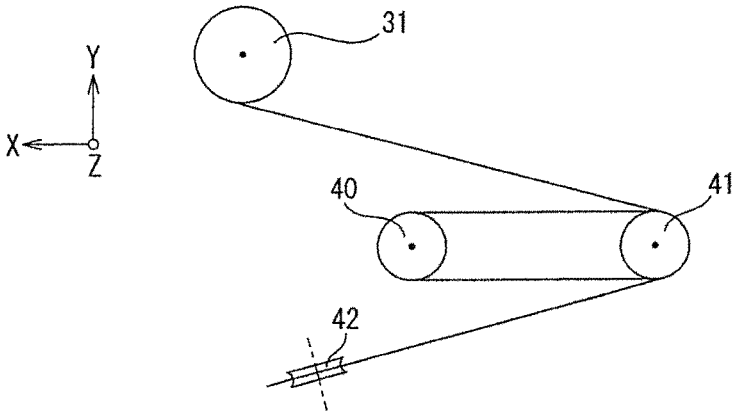
FIG. 6B is a schematic view of the wire layout viewing FIG. 6A from the same direction as FIG. 1.

An embodiment with a different method of stringing a wire 32 of FIGS. 6A and 6B and FIG. 7 will be explained. The method of stringing the wire over the pulleys is not limited to this. It is sufficient that movable pulleys be used so that the power is boosted. FIG. 6A shows an embodiment in the case where the two ends of one wire 32 are fastened to a wire drum 31. The wire 32 fed out from the wire drum 31 is alternately wrapped around a movable pulley 41 and a fixed pulley 40 and further a movable pulley 41 and finally passes through two balance pulleys 42, 42 and is closed (joined together). In the case of FIG. 6A, there are two sets of four movable pulleys 41 and three fixed pulleys. Here, the balance pulleys 42 are used for maintaining the balance and for balancing. The shaft of each movable pulley 41 is supported by a bearing, bush, or slide bearing or other such rotation support part. The shaft of the movable pulley 41 is fastened through the rotation support part to the extrusion movement part 15. The extrusion movement part 15 is designed to move by exactly the distance of movement of the movable pulleys 41. If the wire drum 31 rotates in this way, the movable pulleys 41 move in the extrusion direction corresponding to the speed by which the wire 32 is wound up and the extrusion movement part 15 moves. Note that the force for making the extrusion movement part 15 move becomes a multiple of the number of movable pulleys 41. This is well known as the mechanical advantage of a pulley system (rope and pulley system) using a movable pulley and fixed pulley.

Figure 7:
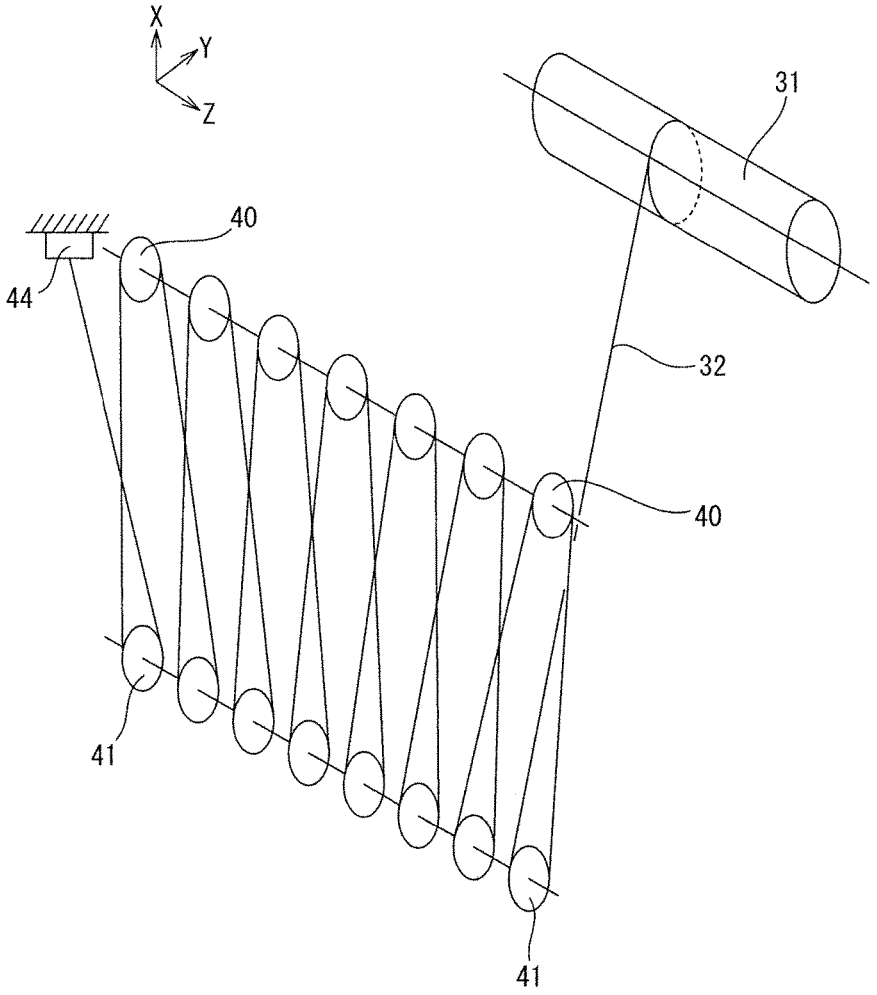
FIG. 7 is a schematic view of the wire layout when fastening just one end of the wire to the wire drum.

FIG. 7 shows the case of using a single wire for making the extrusion movement part 15 move wherein one end of the single wire is fastened to the wire drum 31 and the other end is fastened to the fastening location 44. Wire with one end fastened to the wire drum 31 is strung over these pulleys in the order of the movable pulleys 41 and fixed pulleys 40 and a movable pulley 41 and finally is fastened to a movable pulley 41, fixed pulley 40, or fastening location 44 of the fixed platen etc. In the case of FIG. 7, there are eight movable pulleys 41 and seven fixed pulleys 40. In the case of the embodiment of FIG. 7, no balance pulleys 42 are used. The fastening location 44 corresponds to a balance pulley 42.

Below, FIGS. 1 and 2 explain in detail an embodiment of the extrusion press 10 of the present invention. FIG. 2 is a plan view of the device of FIG. 1 seen from above. In the present embodiment, as shown in FIG. 2, one each extrusion drive device 52 is arranged at the left and right of the extrusion press. At the extrusion drive devices 52, freely rotatable wire drums 31 are arranged above the fixed platen 2. Specifically, the extrusion press 10 is fastened on a machine base 6. Above the fixed platen 2, there is a base 30. On the base 30, the extrusion drive devices 52 (see FIG. 2) are fastened. At the extrusion drive devices 52, wire drums 31 are mounted. The wire drums 31 are driven through speed reducers 35 and clutch couplings 37 by electric powered extrusion-use main motors 36 (AC servo motors are preferable). Reference numeral 38 is a coupling. There is an extrusion stem 13 arranged coaxially with the container 3. The extrusion stem 13 is attached to the crosshead 7. Furthermore, at the opposite side of the crosshead 7 from the extrusion stem 13, an extrusion movement part 15 is fastened. At the extrusion movement part 15, movable pulleys 41 are attached through bearings, slide bearings, etc. The movable pulleys 41 are attached to the rear end part of the extrusion movement part 15 and move together with the extrusion movement part 15. Further, at part of the fixed platen 2, fixed pulleys 40 and balance pulleys 42 are fastened. The wire drums 31, movable pulleys 41, fixed pulleys 40, and balance pulleys 42 are connected by single wires. The electric powered extrusion-use main motors 36 make the wire drums 31 rotate, whereby the extrusion movement part 15 moves. Due to this, the extrusion stem 13 is designed to move back and forth in the extrusion direction.

As shown in FIG. 2, on the fixed platen 2 of the extrusion press 10, one each extrusion drive device 52 is carried at the left and right. Each extrusion drive device 52 is provided with one wire drum 31. Each wire drum 31 is driven through a speed reducer 35 and clutch coupling 37 by an electric powered extrusion-use main motor 36 (AC servo motor is preferable).

As shown in FIG. 6A, a wire drum 31 has the two end parts of a wire 32 fastened to and wound around it. The wire 32 starting from each of the end parts is first wound around a movable pulley 41 then is wound around a fixed pulley 40. It is then further alternately wound around the movable pulleys 41 and the fixed pulleys 40. The wire 32 starting from the end parts is wound around the four movable pulleys 41. After that, the wire is wound around the balance pulleys 42, 42, joined, and closed. In this way, a single through wire is wound around a plurality of pulleys, so it passes through the pulleys by the same tension and is automatically adjusted in tension, so there is no need for the troublesome adjustment of tension like in the prior art. The movable pulleys 41, in the case of FIG. 6A, are bundled into groups of four at the left and right. They are connected at the two sides of the extrusion movement part 15 and convert rotary motion to linear motion. The connecting parts may, for example, be bearings or slide bearings or other such parts. In the case of FIG. 5, the pulleys are bundled into groups of six at the left and right. The shafts of the fixed pulleys 40 and the balance pulleys 42 are attached to the fixed platen 2 through bearings so as to be able to freely rotate. Each wire drum 31 winds up the wire 32 to move the movable pulleys 41 and extrusion movement part 15 in the extrusion direction. Due to this, the extrusion stem 13 is made to advance through the crosshead 7. One or more wire drums 31 may be mounted corresponding to the capacity of the extrusion press 10. Each wire drum 31 is driven through a speed reducer 35 and clutch coupling 37 by an electric powered extrusion-use main motor 36 (AC servo motor is preferable). In each extrusion drive device 52, the wire drum 31 is connected to an output shaft of the speed reducer 35. The input shaft of the speed reducer 35 is connected through the clutch coupling 37 to the output shaft of the extrusion-use main motor 36. The speed reducer 35 and the clutch coupling 37 may also be other machine elements for transmitting power.

When using a wire drum 31 to make the extrusion stem 13 move, the speed is greatly reduced by the speed reducer 35, so is low. However, it is preferable to move the drum at a high speed to shorten the operating time until making the extrusion stem 13 contact the billet 8. Furthermore, a wire drum 31 is used for moving the extrusion stem 13 only in the extrusion (advancing) direction, so movement of the extrusion stem 13 in the pullback (retracting) direction is also necessary. For this reason, a crosshead high speed movement mechanism 45 is provided. In the present embodiment, the crosshead high speed movement mechanism 45 is provided with a crosshead high speed movement motor 43 (AC servo motor or inverter motor is preferable), a ball screw nut 47, a ball screw 46, etc. FIG. 3 shows details of the crosshead high speed movement mechanism 45. The rotation of a pulley 21 attached to the crosshead high speed movement motor 43 is transmitted through a timing belt 22 to a pulley 23. The pulley 23 is fastened to the right end part of the ball screw of FIG. 3 whereby the ball screw 46 is made to rotate. The rotation of the ball screw 46 makes the span 24 set fastened at the right end part of FIG. 3 of the extrusion movement part 15 move at a high speed in the extrusion direction through a ball screw nut 47 fastened to the span 24. In the present embodiment, the mechanism for converting rotary motion of the crosshead high speed movement motor 43 to linear motion is comprised of the ball screw 46 and ball screw nut 47, but it may also be a known mechanism of a rack and pinion etc. In the present embodiment, the crosshead high speed movement mechanism 45, as shown in FIGS. 4 and 5, is supported fastened to the fixed platen 2 through four support columns 49, but it may be supported by another support method as well. Furthermore, when using the crosshead high speed movement mechanism 45 to move the extrusion stem 13 at a high speed, the wire ends up slackening, so to prevent the wire from becoming slack at this time, as shown in FIG. 1, each wire drum 31 is provided with a wire windup device 50. A wire windup motor 51 of the wire windup device 50 is connected to the wire drum 31 through a chain etc. The wire windup motor 51 is made to operate simultaneously with the operation of the crosshead high speed movement motor 43 to drive the wire drum 31 so that the wire does not become slack. The wire windup device 50 forms a wire slack preventing device.

The extrusion press 10 is provided with a machine base 6. On the machine base 6, an end platen 1, fixed platen 2, wire drums 31, speed reducers 35, extrusion-use main motors 36, etc. are installed and fastened. Looking at the center axis of the extrusion press 10, as shown in FIG. 2, the extrusion press 10 is configured substantially symmetric to the left and right. In the extrusion stage, the end platen 1, fixed platen 2, container 3, extrusion stem 13, crosshead 7, and extrusion movement part 15 are arranged so that their center axes match the center axis of the extrusion press.

Furthermore, the extrusion press 10 is provided with a billet loader (not shown), shear device 27, die slide device (not shown) for making the die move, etc. The billet loader supplies the billet 8 between the container 3 and extrusion stem 13. The shear device 27 is placed on the end platen 1 and cuts off the discard of the unnecessary part of the end part of the product after extrusion of the billet 8.

The application and object of the die slide device are (1) to make the die 20 move in the horizontal direction perpendicular to the center axis of the extrusion press and (2) at the time of end of extrusion, cut off the product extruded to the rear of the end platen from the die 20. As the actual operation of (2), a platen saw (not shown) set in the space at the front equipment side in front of the end platen 1 is used to cut the product at the time of end of the extrusion operation. After that, the product is sent to a front table by a conveyor device at the space at the front equipment side. At this time, the remaining material of the product as shaped by the die remains inside the end platen 1. This remaining material is cut off from the die by making the die 20 move to the die changing position by the die slide device at the time of changing the die 20. That is, the remaining material of the product is cut off from the die stack at the front surface of the end platen and the cutting surface of the front surface of the die 20. The remaining material in the die stack is cut off from the die 20 by another cutting device or manual operation after unloading the die stack from the machine.

The container 3 is made to move straight back and forth (advance and retract) by a container operating device 14 comprised of a container operating motor 17, ball screw 46', and ball screw nut 47'. The rotary motion of the container operating motor 17 is converted to linear motion by the ball screw 46' and ball screw nut 47' (similar to FIG. 8). The container operating motor 17 is preferably an inverter motor or AC servo motor. In the case of the front loading type, the container operating device 14 is provided at the fixed platen 2. This is due to the fact that in the case of the front loading type, the stroke of movement of the container is large. The shear device 27 is powered by an electric motor and converts rotary motion to linear motion through a chain or other windup drive mechanism. The die slide device is powered by an electric motor and converts rotary motion to linear motion through a power transmission mechanism comprised of a ball screw and ball screw nut. The stem slider 11 is also powered by an electric motor and uses a mechanism for converting rotary motion to linear motion through a power transmission mechanism comprised of a ball screw and ball nut. The die changer for changing the die and billet loader are also powered by an electric motor. Due to these configurations, the extrusion press can be made fully electric powered. In all power transmission mechanisms powered using electric motors and comprised of a ball screw and ball nut, a timing belt and pulleys were used, but a chain and sprockets can also be used. The same is true in the second embodiment explained below.

Second Embodiment

Figure 9:
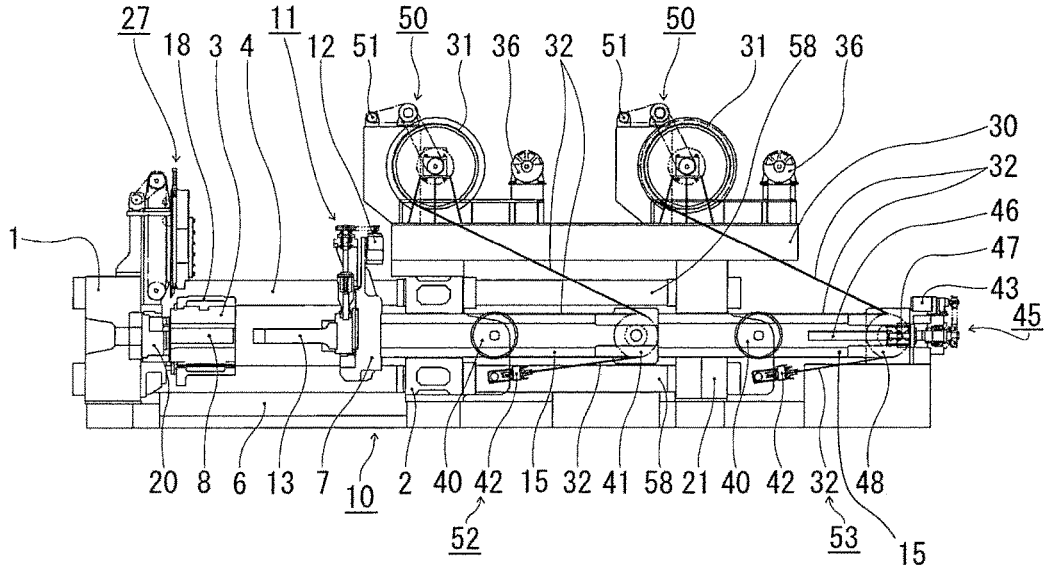
FIG. 9 is a schematic side view showing a second embodiment in the case of provision of four extrusion drive devices of the present invention.
Figure 10:
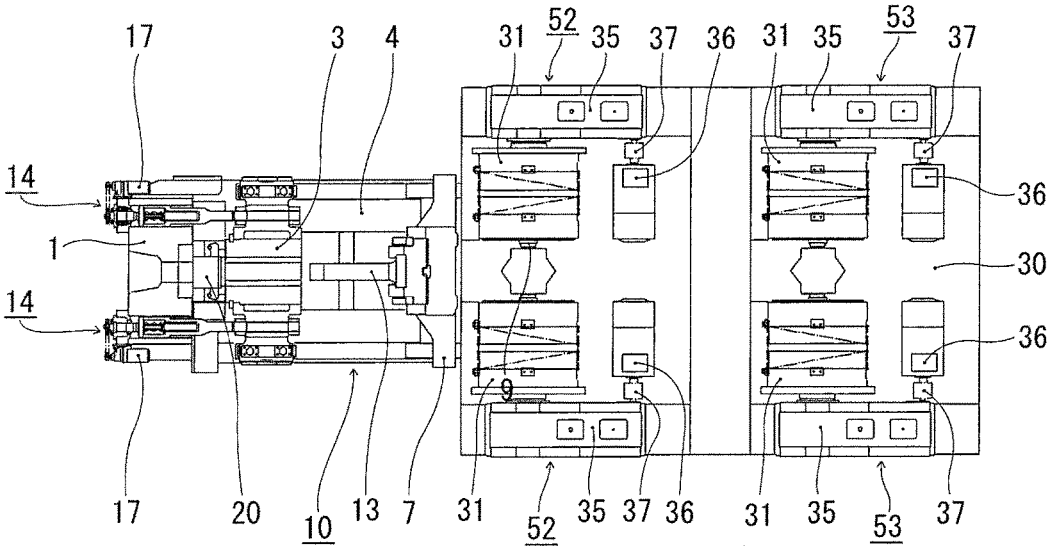
FIG. 10 is a plan view of FIG. 9 seen from above.
Figure 11:
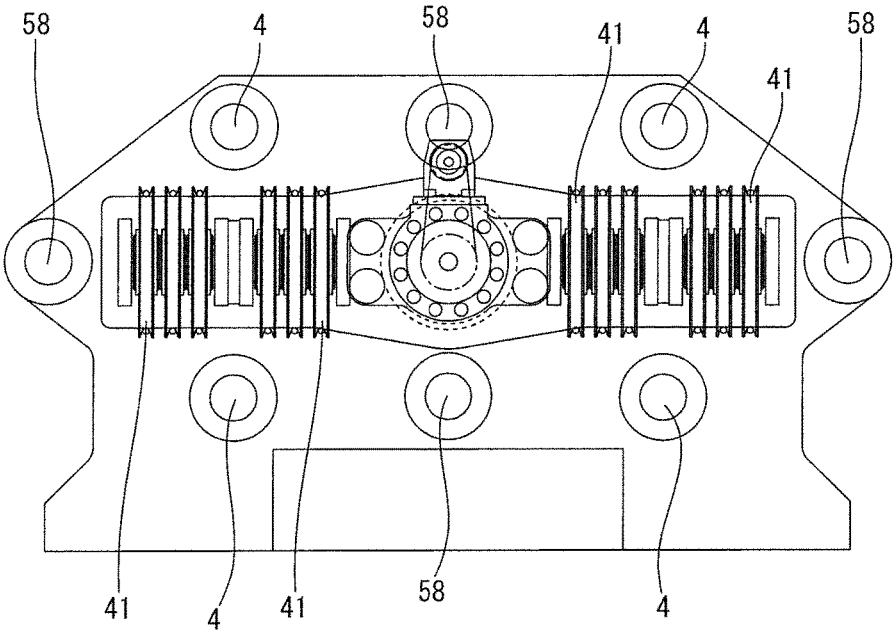
FIG. 11 is a rear view of FIG. 9 seen from the rear.

The second embodiment will be explained using FIGS. 9 to 11. In the second embodiment, the case of four extrusion drive devices will be explained. The two extrusion drive devices of the electric powered extrusion press are further provided with two extrusion drive devices (total four) so two devices each are arranged in series and connected. The fixed platen 2 and fixed platen 21 are connected by the four connecting rods 58 shown in FIG. 11. In FIG. 11, there are four connecting rods 58, but the number may also be greater. Further, the extrusion movement part 15 is fastened at one end part (left side in FIG. 9) at the crosshead 7 and at the other end part (right side in FIG. 9) at the movable pulleys 48 of the extrusion drive devices 53. The movable pulleys 41 of the extrusion drive devices 52 are connected in the middle of the extrusion movement part 15. Further, in the extrusion press of the present embodiment, the extrusion drive devices 52, 53 can make the extrusion movement part 15 move back and forth. The extrusion movement part 15 is a hollow cylindrical shape (may also be polygonal shape or solid shape or other shape) and may also be a certain thickness. Preferably, the parts of the extrusion drive devices 52 are thick and the parts of the extrusion drive devices 53 may be narrowed somewhat. This is because double the extrusion force is taken at the parts of the extrusion drive devices 52. Further, the same can be said for the components transmitting the extrusion force and the components receiving the reaction force of the extrusion force.

Separate from the crosshead high speed movement mechanism 45 and the extrusion drive devices 53, wire windup devices 50 may also be provided. The wire windup devices 50 can make the wire drums 31 rotate forward and reverse to wind up or feed out wires 32 on or from the wire drums 31. The wire windup devices 50 are provided at the wire drums 31 of the extrusion drive devices 52, 53. At the next stages (1) and (2), a crosshead high speed movement mechanism is used.

(1) Stage at the time of start of the extrusion process from when a billet 8 advances until it abuts against the die 20 where no extrusion load acts on the extrusion stem 13.

(2) Stage at the time of retraction of the extrusion stem 13 when the crosshead high speed movement mechanism 45 drives the extrusion stem to retract at a high speed through the extrusion movement part 15. At this time, it is necessary to operate the wire windup devices 50 to wind up and feed out the wires 32.

In the second embodiment, as drive units, extrusion drive devices are mechanically connected. By controlling the speeds of the motors of the extrusion drive devices to synchronize them, it is possible to transmit the composite pushing load of the plurality of extrusion drive devices to the extrusion stem.

In the above case, the case where two each extrusion drive devices 52, 53 were provided in series, that is, a total of four, was explained, but in the case where further greater numbers of extrusion drive devices 52, 53 are provided in series, the configuration is the same.

The stem slide type extrusion press falls under the category of rear loading types of short stroke types. The extrusion press 10 of the present embodiment was explained with reference to the example of a stem slide type of extrusion press, but the fact that the present invention can also be applied to a short stroke type front loading type or a conventional type not provided with a stem slider, should be easily understandable to a person skilled in the art. Further, the configuration of the present invention, as explained above, was explained with reference to the example of a direct type extrusion press, but person skilled in the art should be able to easily understand that the present invention can be similarly applied to an indirect type extrusion press.

As explained above, the present invention has the following effects. The present invention does not use any hydraulic devices for its main parts but uses an electrically powered drive system, so the maintenance ability can be improved, energy can be saved, and the operating efficiency and performance of the machine become excellent. Further, the source of noise changes from the main pumps to the main motors, so the noise can be reduced. Therefore, the work environment is improved, the machine becomes good in operability, and a greater improvement to the productivity of the extruded product is realized.

Further, since the load transfer medium is a single through wire, even if connected to a plurality of pulleys, it passes over the pulleys by the same tension so is automatically adjusted in tension. There is no need for the troublesome adjustment of tension like in the prior art. On top of this, since a plurality of pulleys are connected in parallel, the assembly acts as a speed reducer, it becomes possible to lower the speed reduction ratio of the speed reducer used from the main motor to the wire drum to boost the power, and the electric powered drive device as a whole can be configured from more compact drive parts.

Furthermore, by arranging a plurality of the electric powered drive devices in the extrusion direction in series and serially connecting the movement parts of the crosshead (extrusion movement part 15), even when a greater extrusion ability is demanded, realization becomes possible without any need to make the individual drive parts larger.

REFERENCE SIGNS LIST

1. end platen
2. fixed platen
3. container
4. tie rod
6. machine base
7. crosshead
8. billet
10. extrusion press
11. stem slider
12. stem slide motor
13. extrusion stem
14. container operating device
15. extrusion movement part
17. container operating motor
18. container holder
20. die
21. fixed platen
27. shear device
30. base
31. wire drum
32. wire
35. speed reducer
36. extrusion-use main motor
37. clutch coupling
40. fixed pulley
41. movable pulley
42. balance pulley
43. crosshead high speed movement motor
44. fastening location
45. crosshead high speed movement mechanism
46. ball screw
47. ball screw nut
48. movable pulley

49. support column
50. wire windup device
51. wire windup motor
52. extrusion drive device
53. extrusion drive device
58. connecting rod

The invention claimed is:

1. An extrusion press comprising an end platen, die, container, crosshead having an extrusion stem, and a fixed platen on which an electric powered drive device and fixed pulleys are provided, that pushes said extrusion stem to thereby push a billet out from said die to obtain a predetermined product, wherein said electric powered drive device is provided with an extrusion-use main electric motor and one or more wire drums provided to be able to freely rotate, said crosshead is provided with an extrusion movement part to which movable pulleys are fastened, said extrusion-use main electric motor rotates said wire drums to wind up wires and thereby thrust said movable pulley in an extrusion direction, said crosshead and said extrusion stem are driven to advance through said extrusion movement part, and a single wire is wound around said wire drum from two ends of said wire, one end part is fastened to said wire drum, said wire is strung between said fixed pulleys and movable pulleys, and the other end part of the wire is also fastened to said wire drum.

2. The extrusion press according to claim 1, wherein a plurality of said electric powered drive devices are arranged in an extrusion direction in series, each said electric powered drive device is provided with components comprising an extrusion-use main electric motor, wire, wire drum, fixed pulleys, and movable pulleys, and each movable pulley is fastened to said extrusion movement part.

3. The extrusion press according to claim 2, wherein an electric powered drive device of the plurality of the electric powered drive devices, arranged relatively further away from said cross-head, has a lower strength than an electric powered drive device of the plurality of the electric powered drive devices arranged relatively closer to said cross-head.

4. The extrusion press according to claim 1, wherein the fixed pulleys and movable pulleys function as a speed reducer.

5. The extrusion press according to claim 1, further comprising a wire slack preventing device.

6. The extrusion press according to claim 1, wherein a tail end of said extrusion movement part is provided with a movement mechanism comprising an electric motor, a ball screw nut and a ball screw enabling said crosshead to advance and retract at a higher speed than when said crosshead is driven to advance by an operation of said electric powered drive device.

* * * * *